US007504571B2

(12) United States Patent
Hilliard et al.

(10) Patent No.: US 7,504,571 B2
(45) Date of Patent: Mar. 17, 2009

(54) SHOULDER MARCHING TUBA WITH VIEW LEFT

(75) Inventors: Gregory Hilliard, Delavan, WI (US); Michael Kamphuis, Three Rivers, MI (US)

(73) Assignee: Conn-Selmer, Inc., Elkhart, IN (US)

( * ) Notice: Subject to any disclaimer, the term of this patent is extended or adjusted under 35 U.S.C. 154(b) by 0 days.

(21) Appl. No.: 11/944,990

(22) Filed: Nov. 26, 2007

(65) Prior Publication Data

US 2008/0092718 A1 Apr. 24, 2008

Related U.S. Application Data

(60) Provisional application No. 60/868,114, filed on Dec. 1, 2006.

(51) Int. Cl.
*G10D 9/00* (2006.01)

(52) U.S. Cl. ..... 84/385 A

(58) Field of Classification Search ..... 84/380 R, 84/385 A, 387 A

See application file for complete search history.

(56) References Cited

U.S. PATENT DOCUMENTS

| | | | | |
|---|---|---|---|---|
| 2,608,122 A * | 8/1952 | Solarz | ..... | 84/388 |
| 3,631,755 A | 1/1972 | Glantz et al. | | |
| 4,469,002 A | 9/1984 | Thayer | | |
| 5,894,098 A | 4/1999 | Hsieh | | |

* cited by examiner

*Primary Examiner*—Kimberly R Lockett
(74) *Attorney, Agent, or Firm*—Fish & Richardson P.C.

(57) ABSTRACT

A shoulder marching tuba having an arrangement of air flow tubing that defines a viewing region or viewing window to provide a musician playing the tuba with a relatively unobstructed view left through the tuba while marching.

8 Claims, 7 Drawing Sheets

SHOULDER MARCHING TUBA WITH VIEW LEFT

CROSS-REFERENCE TO RELATED APPLICATIONS

This U.S. patent application claims priority under 35 U.S.C. §119(e) to a U.S. provisional patent application 60/868,114, filed on Dec. 1, 2006, the entire contents of which are hereby incorporated by reference.

TECHNICAL FIELD

This invention relates to shoulder marching tuba musical instruments.

BACKGROUND

Over-the-shoulder marching tubas typically have a cluster of tubing just to the left of the player's head which may impede the ability of the player to see to his/her left side. Consequently, drill writers for marching bands or drum corps typically accommodate for this impediment in the composition of field shows. In other words, the tuba player's maneuvers are limited to those requiring a clear view (guide) to the left. Other brass players (trumpet, horn, baritone, etc) generally do not suffer this limitation.

SUMMARY

According to the disclosure, a shoulder marching tuba has an arrangement of air flow tubing that defines a relatively open viewing region to provide a musician playing the tuba with an unobstructed view to the left during marching.

In one aspect, a shoulder marching tuba includes an air inlet mouthpiece, an air outlet bell, and a series of airflow tubing and valves in fluid communication therebetween. The valves are disposed towards a forward portion of the tuba and the tubing is arranged to define a relatively open viewing region positioned to provide a user with a view through the open region while operating the tuba.

In one example, the tuba includes a first substantially U-shaped tube having first and second ends. The first substantially U-shaped tube defines a relatively open viewing region for a user operating the tuba. A valve system for adjustment of musical pitch of sound issued from the tuba is in fluid communication with the second end of the first substantially U-shaped tube and located on a forward side of the viewing region. The tube also includes a second substantially U-shaped tube having first and second ends. The second end is in fluid communication with the first end of the first substantially U-shaped tube. A mouth piece is in fluid communication with the first end of the second substantially U-shaped tube and is positioned to provide a user a view through the viewing region while operating the tuba. The tuba includes a third substantially U-shaped tube having first and second ends, where the first end is in fluid communication with the valve system. A first end of a fourth substantially U-shaped tube is in fluid communication with the second end of the third substantially U-shaped tube and positioned below the viewing region. In addition, a second end of the fourth substantially U-shaped tube is positioned above the viewing region.

The tube also includes fifth and sixth substantially U-shaped tubes, each having first and second ends. The first end of the fifth substantially U-shaped tube is in fluid communication with the second end of the fourth substantially U-shaped tube and the second end of the fifth substantially U-shaped tube is positioned below the viewing region. The first end of the sixth substantially U-shaped tube is in fluid communication with the second end of the fifth substantially U-shaped tube. A bell is in fluid communication with the second end of the sixth substantially U-shaped tube and positioned above the viewing region.

In other implementations, the tuba also includes at least one brace secured between a first leg and a second leg of the first substantially U-shaped tube in a manner to support both legs substantially parallel to define upper and lower bounds of the viewing region. Similarly, the tuba may also include a valve brace secured between a first leg of the first substantially U-shaped tube and the valve system in a manner to hold the first and second legs of the first substantially U-shaped tube substantially parallel.

In yet another implementation, the valve assembly of the tuba includes a first, second, and third valve systems. The first valve system includes a first valve and a first valve system tube having first and second ends, both in fluid communication with the first valve. The second valve system is in fluid communication with the first valve system and includes a second valve and a second valve system tube having first and second ends, both in fluid communication with the second valve. The third valve system is in fluid communication with the second valve system and includes a third valve and a third valve system tube having first and second ends, both in fluid communication with the third valve. The first, second, and third valve system tubes are positioned about a periphery of the viewing region, framing a viewing window.

In one implementation, the second valve system tube includes a crook and first and second legs joining the crook to the second valve. The first and second legs are curved to position the crook along side the first valve system tube. Similarly, the third valve system tube further includes a crook as well as first and second legs, both in fluid communication with the crook. First and second curved ends join the first and second legs of the third valve system, respectively, to the third valve such that the first and second legs of the third valve system are substantially parallel.

The shoulder marching tuba may also include first, second, and third rings mounted on the tuba to aid a user in holding the tuba. The first ring is mounted upon the first substantially U-shaped tube, the second ring is mounted upon the second substantially U-shaped tube, and the third ring mounted upon the first valve system tube. The rings are configured to aid the user in holding and playing the tuba.

The tuba may further include a mouthpiece tube. A second end of the mouthpiece tube is in fluid communication with the first end of the second substantially U-shaped tube. A first end of the mouthpiece tube is in fluid communication with the mouthpiece.

The details of one or more implementations of the disclosure are set fourth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

A shoulder marching tuba has an air flow tubing configuration arranged to provide the instrument player with a view to the left. Prior art shoulder marching tubas typically have a view left that is obstructed by a cluster of tubing, which has restricted marching band choreographers from implementing maneuvers requiring tuba players to see to the left.

Figure 1:
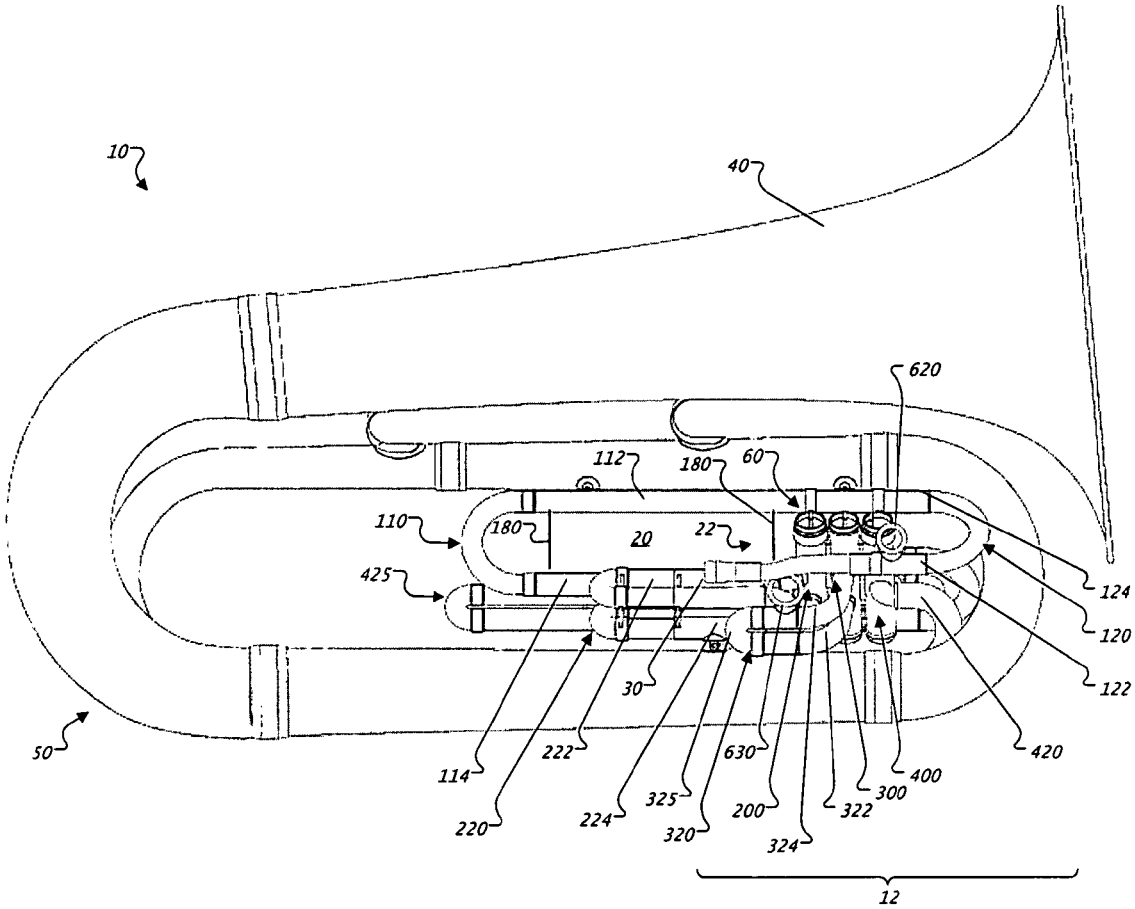
FIG. 1 is a side view of a shoulder marching tuba.

Referring to FIG. 1, the illustrated shoulder marching tuba 10 depicts a viewing region or viewing window feature 20 of the tuba for a user. Over-the-shoulder marching tubas generally have a cluster of tubing just to the left of the player's head, limiting the ability of the player to see to his/her left side. Consequently, it has become standard practice of the drill writers for the marching band or drum corps to accommodate for this limitation in the composition of field shows. In other words, the tuba player's maneuvers are limited to those where they do not need to see (guide) to the left. Other brass players (trumpet, horn, baritone, etc) do not have this limitation.

Figure 2:
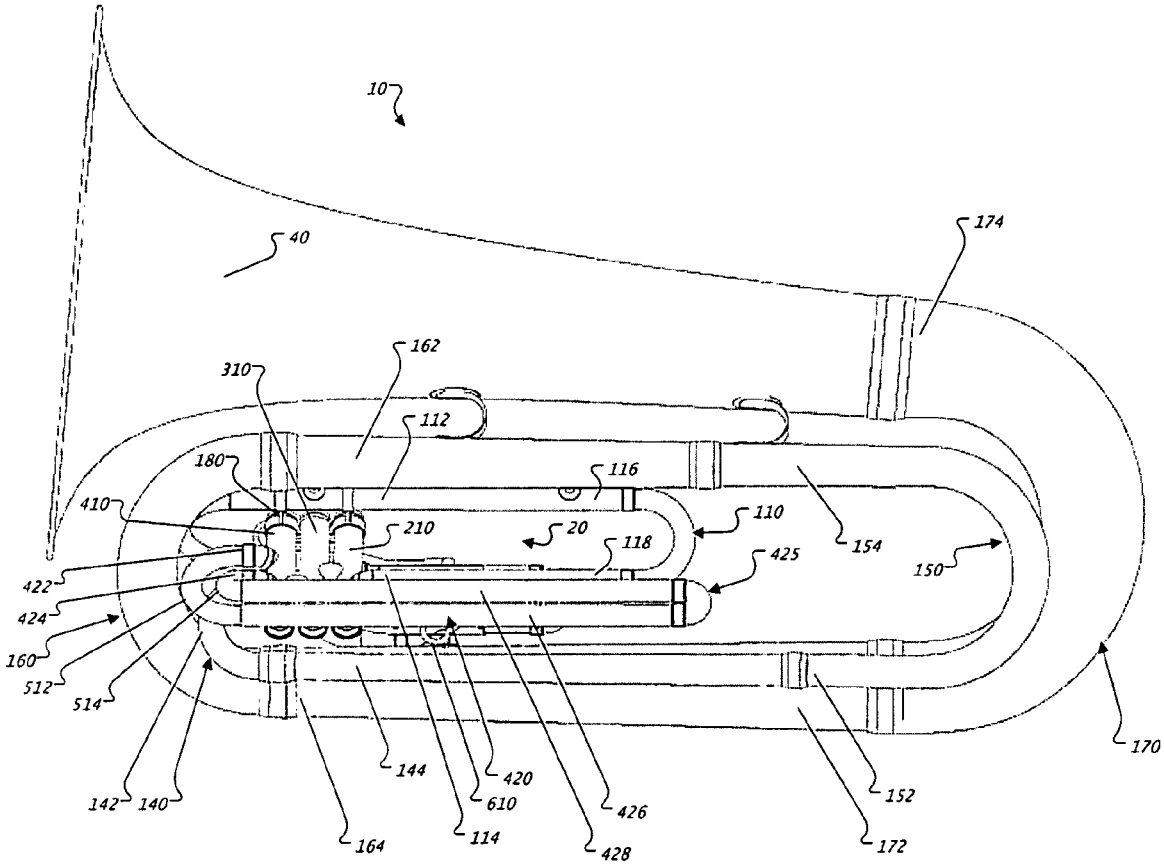
FIG. 2 is a side view of a shoulder marching tuba.
Figure 3:
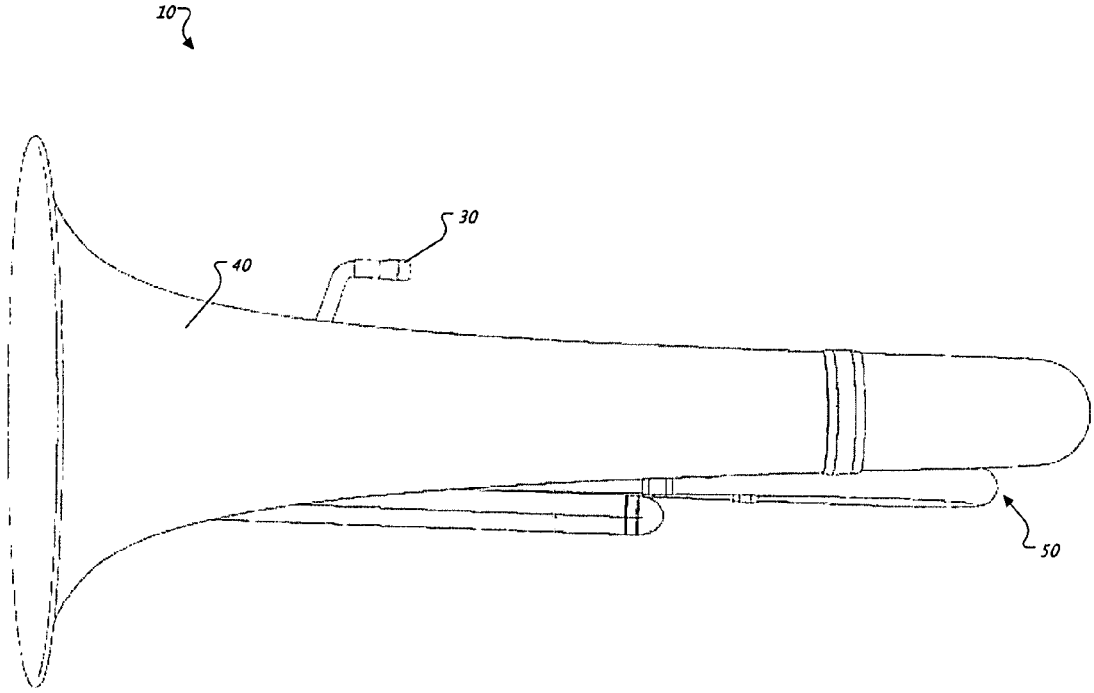
FIG. 3 is a top view of a shoulder marching tuba.

Referring to FIGS. 1-2, shoulder marching tuba 10 includes air inlet mouthpiece 30, air outlet bell 40, and a series of airflow tubing 50 and valves 60 in fluid communication therebetween. Valves 60 are disposed towards a forward portion 12 of tuba 10 and the tubing 50 is arranged to define the viewing region 20 placed to provide a user with a view through region 20 while operating tuba 10.

In one example, shoulder marching tuba 10 includes first substantially U-shaped tube 110 having first and second ends, 112 and 114 respectively. First substantially U-shaped tube 110 defines viewing window 20 for a user operating tuba 10. Valve system 60 for adjustment of musical pitch of sound issued from tuba 10 is in fluid communication with the second end 114 of first substantially U-shaped tube 110 and located on a forward side 22 of viewing window 20.

Figure 4:
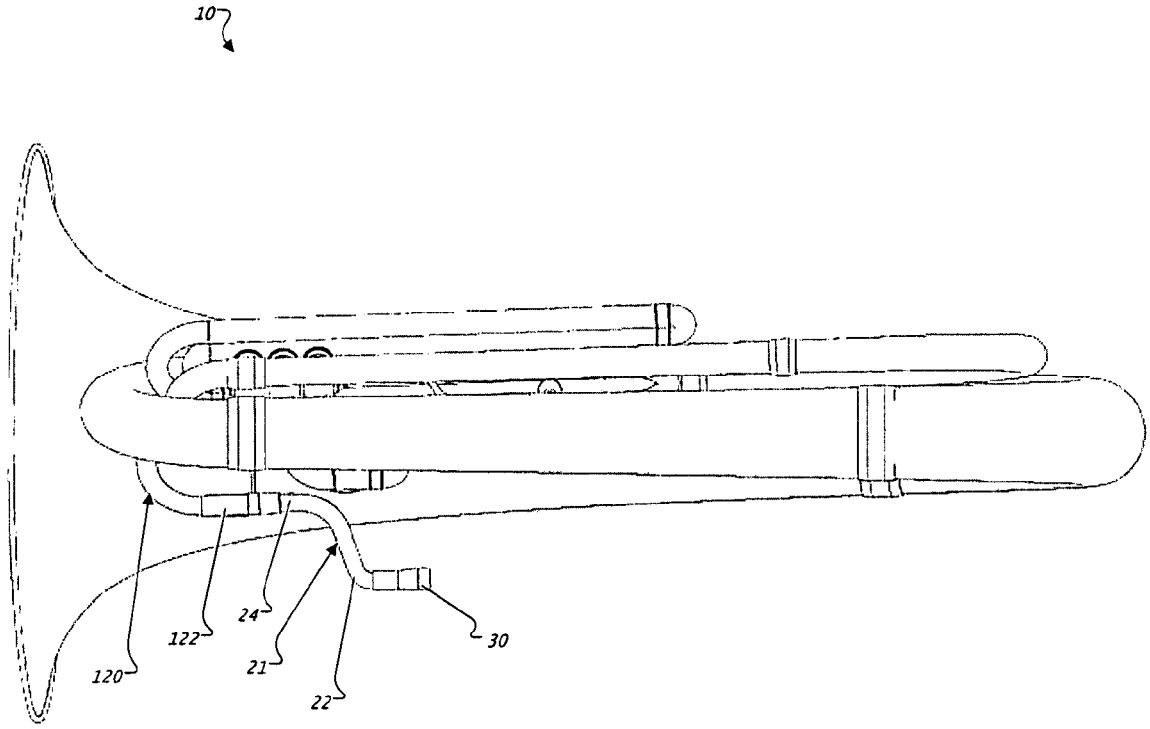
FIG. 4 is a bottom view of a shoulder marching tuba.
Figure 5:
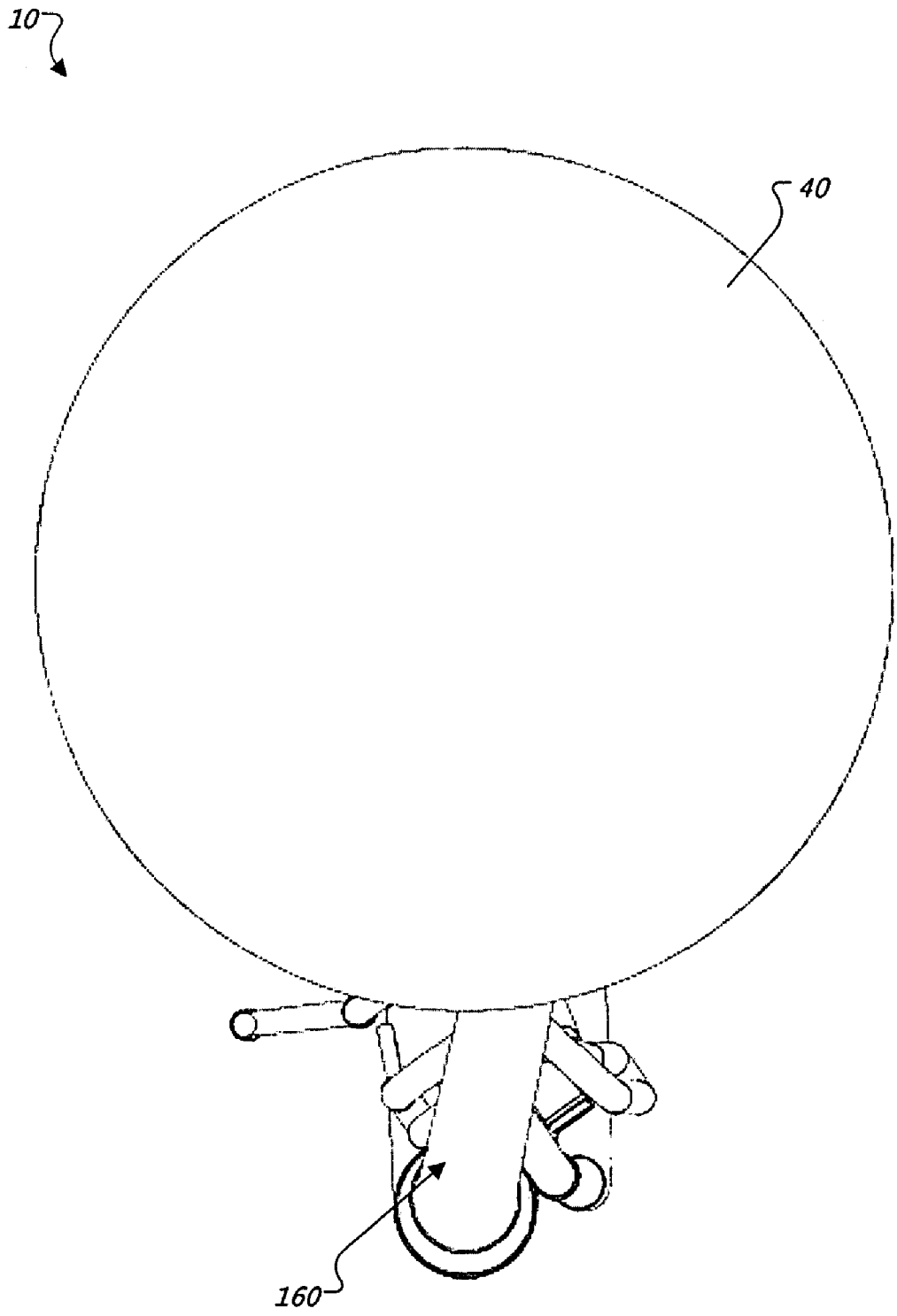
FIG. 5 is a front view of a shoulder marching tuba.
Figure 6:
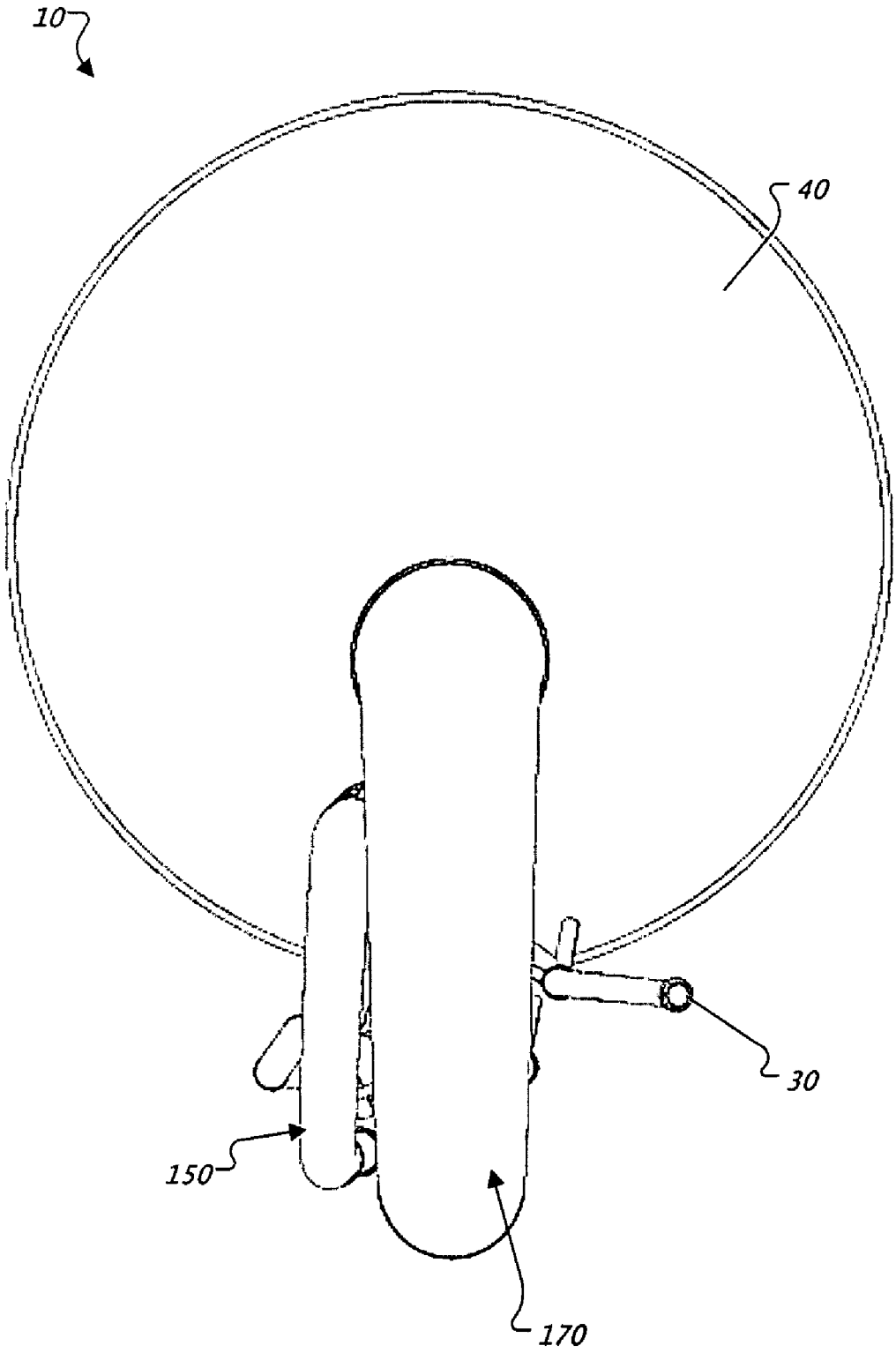
FIG. 6 is a rear view of a shoulder marching tuba.

Referring to FIG. 4, second substantially U-shaped tube 120 has first and second ends, 122 and 124 respectively. The second end 124 is in fluid communication with the first end 112 of first substantially U-shaped tube 110. Mouth piece 30 is in fluid communication with the first end of second substantially U-shaped tube 120. Mouth piece 30 is positioned to provide a user a relatively unobstructed view through viewing window 20 while operating tuba 10. To provide ergonomic placement of a head of a user in relation to tuba 10, in another example, tuba 10 includes mouthpiece tube 21 having first and second ends 22 and 24, respectively. The second end 24 of mouthpiece tube 21 is in fluid communication with the first end 122 of fourth substantially U-shaped stationary tube 120. The first end 22 of mouthpiece tube 21 is in fluid communication with mouthpiece 30.

Referring to FIGS. 1-6, third substantially U-shaped tube 140 has first and second ends, 142 and 144 respectively. The first end 142 is in fluid communication with valve system 60. Fourth substantially U-shaped tube 150 has first and second ends, 152 and 154 respectively. The first end 152 is in fluid communication with the second end 144 of third substantially U-shaped tube 140 and is positioned below window 20. The second end 154 of fourth substantially U-shaped tube 150 is positioned above viewing window 20.

Fifth substantially U-shaped tube 160 has first and second ends, 162 and 164 respectively. The first end 162 is in fluid communication with the second end 154 of fourth substantially U-shaped tube 150 and the second end 164 of fifth substantially U-shaped tube 160 is positioned below viewing window 20.

Sixth substantially U-shaped tube 170 has first and second ends, 172 and 174 respectively. The first end 172 is in fluid communication with the second end 164 of fifth substantially U-shaped tube 160. Bell 40 is in fluid communication with the second end 174 of sixth substantially U-shaped tube 170 and is positioned above viewing window 20.

Referring to FIG. 2, in another example, shoulder marching tuba 10 includes at least one brace 180 secured between first leg 116 and second leg 118 of first substantially U-shaped tube 110 in a manner to hold both legs, 116 and 118, substantially parallel to define upper and lower bounds of viewing window 20. Similarly, in another example, shoulder marching tuba 10 includes valve brace 180 secured between first leg 116 of first substantially U-shaped tube 110 and valve system 60 in a manner to hold the first and second legs, 116 and 118 respectively, of first substantially U-shaped tube 110 substantially parallel.

Referring to FIGS. 1-2, in some examples, value assembly 60 includes first valve system 200 which includes first valve 210 and first valve system tube 220 having first and second ends, 222 and 224 respectively, both in fluid communication with first valve 210. Valve assembly 60 also includes second valve system 300 in fluid communication with first valve system 200. Second valve system 300 includes second valve 310 and second valve system tube 320 having first and second ends, 322 and 324 respectively, both in fluid communication with second valve 300. Third valve system 400 is in fluid communication with second valve system 300. Third valve system 400 including third valve 410 and third valve system tube 420 having first and second ends, 422 and 424 respectively, both in fluid communication with third valve 400. The first, second, and third valve system tubes, 220, 320, and 420 respectively, are positioned about a periphery of viewing window 20.

In one embodiment, second valve system tube 320 includes crook 325 and first and second legs, 326 and 328 respectively, joining crook 325 to second valve 310. First and second legs, 326 and 328 respectively, are curved to position crook 325 along side first valve system tube 220. In another embodiment, third valve system tube 420 includes crook 425 and first and second legs, 426 and 428 respectively, both in fluid communication with crook 425. First and second curved ends, 512 and 514 respectively, join first and second legs, 426 and 428 respectively, to third valve 410 such that first and second legs, 426 and 428 respectively, of third valve system 400 are substantially parallel.

In another example, shoulder marching tuba 10 includes first ring 610 mounted upon first substantially U-shaped tube 110, second ring 620 mounted upon second substantially U-shaped tube 120, and third ring 630 mounted upon first valve system tube 220.

Figure 7:
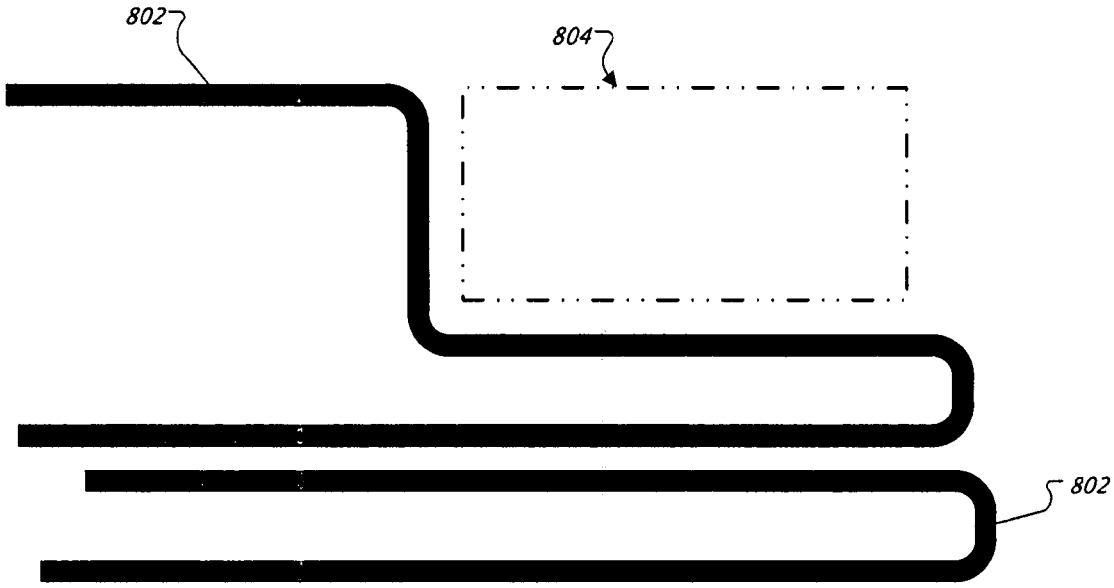
FIG. 7 is a side view of a viewing region of a shoulder marching tuba.

A number of implementations have been described. Nevertheless, it will be understood that various modifications may be made without departing from the spirit and scope of the disclosure. For example, shoulder marching tubas may have other arrangements of air flow tubing providing a relatively unobstructed view left, e.g. as suggested in FIG. 7 where tubing 802 is arranged generally below the viewing region or window 804. Accordingly, other implementations are within the scope of the following claims.

What is claimed is:

1. A shoulder marching tuba comprising:

a first substantially U-shaped tube having first and second ends, the first substantially U-shaped tube defining a viewing region for a user operating the tuba;

a valve system for adjustment of musical pitch of sound issued from the tuba in fluid communication with the second end of the first substantially U-shaped tube and located on a forward side of the viewing region;

a second substantially U-shaped tube having first and second ends, the second end in fluid communication with the first end of the first substantially U-shaped tube;

a mouth piece in fluid communication with the first end of the second substantially U-shaped tube, wherein the mouth piece is positioned to provide a user a view through the viewing region while operating the tuba;

a third substantially U-shaped tube having first and second ends, the first end in fluid communication with the valve system;

a fourth substantially U-shaped tube having first and second ends, the first end in fluid communication with the second end of the third substantially U-shaped tube and positioned below the viewing region, the second end of the fourth substantially U-shaped tube positioned above the viewing region;

a fifth substantially U-shaped tube having first and second ends, the first end in fluid communication with the second end of the fourth substantially U-shaped tube, the second end of the fifth substantially U-shaped tube positioned below the viewing region;

a sixth substantially U-shaped tube having first and second ends, the first end in fluid communication with the second end of the fifth substantially U-shaped tube; and a bell in fluid communication with the second end of the sixth substantially U-shaped tube and positioned above the viewing region.

2. The shoulder marching tuba of claim 1 further comprising at least one brace secured between a first leg and a second leg of the first substantially U-shaped tube in a manner to hold both legs substantially parallel to define upper and lower bounds of the viewing region.

3. The shoulder marching tuba of claim 1 further comprising a valve brace secured between a first leg of the first substantially U-shaped tube and the valve system in a manner to hold the first and second legs of the first substantially U-shaped tube substantially parallel.

4. The shoulder marching tuba of claim 1 wherein the value assembly comprises:

a first valve system comprising:

a first valve;

a first valve system tube having first and second ends, both in fluid communication with the first valve;

a second valve system in fluid communication with the first valve system, the second valve system comprising:

a second valve; and a second valve system tube having first and second ends, both in fluid communication with the second valve; and a third valve system in fluid communication with the second valve system, the third valve system comprising:

a third valve; and a third valve system tube having first and second ends, both in fluid communication with the third valve;

wherein the first, second, and third valve system tubes are positioned about a periphery of the viewing region.

5. The shoulder marching tuba of claim 4 wherein the second valve system tube further comprises:

a crook; and first and second legs joining the crook to the second valve and curved to position the crook along side the first valve system tube.

6. The shoulder marching tuba of claim 4 wherein the third valve system tube further comprises:

a crook;

first and second legs, both in fluid communication with the crook; and first and second curved ends joining the first and second legs, respectively, to the third valve, wherein the first and second legs of the third valve system are substantially parallel.

7. The shoulder marching tuba of claim 1 further comprising:

a first ring mounted upon the first substantially U-shaped tube;

a second ring mounted upon the second substantially U-shaped tube; and a third ring mounted upon the first valve system tube.

8. The shoulder marching tuba of claim 1 further comprising a mouthpiece tube having first and second ends, the second end of the mouthpiece tube in fluid communication with the first end of the second substantially U-shaped tube; the first end of the mouthpiece tube in fluid communication with the mouthpiece.

* * * * *